United States Patent [19]

Hashimoto et al.

[11] Patent Number: 4,544,295

[45] Date of Patent: Oct. 1, 1985

[54] MECHANICAL PENCIL WITH SELF-CONTAINED INSERT

[75] Inventors: Yasuyuki Hashimoto, Hyogo; Kazuo Shimizu, Osaka, both of Japan

[73] Assignee: Ancos Co., Ltd., Osaka, Japan

[21] Appl. No.: 500,755

[22] Filed: Jun. 3, 1983

[30] Foreign Application Priority Data

Jun. 3, 1982 [JP] Japan ..... 57-81605[U]

[51] Int. Cl.[4] ..... B43K 24/08; B43K 21/22

[52] U.S. Cl. ..... 401/65; 401/67; 401/94; 401/110

[58] Field of Search ..... 401/65, 67, 116, 110, 401/111, 94

[56] References Cited

U.S. PATENT DOCUMENTS

| | | | |
|---|---|---|---|
| 387,042 | 7/1888 | Bohren | 401/110 X |
| 3,192,904 | 7/1965 | Johmann | 401/103 |
| 3,724,960 | 4/1973 | Hashimoto et al. | 401/67 |
| 3,765,781 | 10/1973 | Hashimoto et al. | 401/67 |
| 4,106,874 | 8/1978 | Torii | 401/67 |

FOREIGN PATENT DOCUMENTS

| | | | |
|---|---|---|---|
| 2103043 | 7/1979 | Fed. Rep. of Germany | 401/67 |
| 3118119 | 3/1982 | Fed. Rep. of Germany | 401/65 |
| 10026 | of 1887 | United Kingdom | 401/110 |

*Primary Examiner*—Steven A. Bratlie

*Attorney, Agent, or Firm*—Sughrue, Mion, Zinn, Macpeak & Seas

[57] ABSTRACT

A mechanical pencil comprising a pencil barrel, a cam cylinder mounted in the pencil barrel at a front portion thereof and having a cam wall formed on an inner circumferential surface, a cylindrical slide cam engaged with the cam wall for back-and-forth movement therein, a rotatable cam disposed in front of the slide cam and having a central hole, an inner fitting and a clamp support connected together and disposed in front of the rotatable cam, a pusher for pushing the slide cam, a spring for urging the inner fitting and the clamp support to move backwardly, the inner fitting, a lead holder mounted in the inner fitting for holding a lead with a light force, a cylindrical clamp disposed behind the lead holder and movable back and forth by a slight interval, a chuck fitted in the clamp, a lead pipe connected to a rear end of the chuck and having a diameter small enough to allow passage therethrough of one lead at a time, the lead pipe extending through the rotatable cam and the slide cam, a lead casing connected to a rear end of the lead pipe, another spring for urging the interconnected chuck, lead pipe and lead casing to move backwardly, and a stop portion for preventing the chuck, the lead pipe and the lead casing from being retracted beyond a certain interval.

13 Claims, 5 Drawing Figures

MECHANICAL PENCIL WITH SELF-CONTAINED INSERT

BACKGROUND OF THE INVENTION

The present invention relates to a mechanical pencil having an internal mechanism with its distal end movable into and out of an opening in a distal end of a pencil barrel in response to a larger push, wherein a lead can be projected in response to a smaller push under a writing condition in which the distal end of the internal mechanism projects out of the opening in the pencil barrel.

There have already been proposed mechanical pencils in which the distal end of an internal mechanism is moved in and out by a larger push and a lead is projected by a smaller push, as disclosed in U.S. Pat. No. 3,724,960, Japanese Patent Publication No. 14524/79 and Japanese Utility Model Publications Nos. 34328/76 and 34329/76. These known mechanical pencils have a cam mechanism disposed on an outer circumferential surface of a lead casing for taking the distal end of the internal mechanism into and out of the opening in the distal end of the pencil barrel. The lead casing is considerably large in diameter so as to be able to contain a multiplicity of leads. With the cam mechanism disposed around the thick lead casing, the pencil barrel having a cam wall aligned with the cam mechanism must also be large in diameter. This has been an obstacle to attempts to achieve mechanical pencils of smaller diameter. In the known mechanical pencils, the cam mechanism is integral with a rear pencil barrel. It is frequent practice in the mechanical pencil industry for manufacturers to buy and sell their products among themselves. For example, many makers purchase only internal mechanisms from other makers, assemble them into pencil barrels of their own, and sell completed products under their own brands.

It is desirable that one manufacturer fabricate a quantity of versatile internal mechanisms and sell them to a plurality of companies of writing instruments, and the companies assemble the purchased internal mechanisms into pencil barrels of their own for sale under their own brand names. Since such a way of business allows the manufacturer to mass-produce internal mechanisms of one type, the cost of production can be reduced and the internal mechanisms can be sold to other makers at reduced prices. The companies of writing tools then can put purchased mechanisms into their own barrels, so that they can sell the products under their own names to their advantage. Therefore, the consumers can buy completed mechanical pencils at reasonable prices. The foregoing practice is considered totally as a good production and selling system to provide benefits to all of the internal mechanism manufacturer, the assembling makers, and the consumers. However, since the cam mechanism has heretofore been formed integrally with the rear pencil barrel, it has been impossible for one manufacturer to sell only internal mechanisms to other makers.

SUMMARY OF THE INVENTION

It is an object of the present invention to provide a mechanical pencil which has a slim pencil barrel of a reduced diameter and an internal mechanism separate from the pencil barrel so that only internal mechanisms can be manufactured and sold.

According to the present invention, there is provided a mechanical pencil comprising a pencil barrel, a cam cylinder mounted in the pencil barrel at a front portion thereof and having a cam wall formed on an inner circumferential surface, a cylindrical slide cam engaged with the cam wall for back-and-forth movement therein, a rotatable cam disposed in front of the slide cam and having a central hole, an inner fitting and a clamp support connected together and disposed in front of the rotatable cam, a spring $S_1$ for urging the inner fitting and the clamp support to move backwardly, the inner fitting having a tapered distal end, a lead holder mounted in the inner fitting for holding a lead with a light force, a cylindrical clamp disposed behind the lead holder and movable back and forth by a slight interval, a chuck fitted in the clamp, a lead pipe connected to a rear end of the chuck and having a diameter small enough to allow passage therethrough of one lead at a time, the lead pipe extending through the rotatable cam and the slide cam to a position behind the slide cam, a lead casing connected to a rear end of the lead pipe, a pusher mounted on the interconnected lead pipe and lead casing and positioned behind the slide cam, another spring $S_2$ for urging the interconnected chuck, lead pipe and lead casing to move backwardly, and means for preventing the chuck, the lead pipe and the lead casing from being retracted beyond a certain interval.

According to another aspect of the invention, there is provided an internal mechanism for a pencil barrel of a mechanical pencil, the pencil barrel having a front opening and a rear opening at front and rear ends, respectively, the internal mechanism comprising: a first movable mechanism including an inner fitting having an opening through which a lead is supplied and a clamp support coupled to the inner fitting, first biasing means for biasing said first movable mechanism rearwardly, lead holding means mounted in said inner fitting for holding the lead with a light force, a cylindrical clamp located behind the lead holder and movable back and forth by a short distance in the first movable mechanism, a second movable mechanism including a chuck cooperating with the cylindrical clamp, a lead pipe connected to a rear end of the chuck and having a diameter small enough to allow passage therethrough of one lead at a time, a lead casing connected to said lead pipe for encasing therein extra leads, and a pusher, second biasing means for biasing the second movable mechanism rearwardly, cam means for retaining the first movable mechanism selectively between a retracted position and a writing position, the cam means actuated by the pusher of the second inner mechanism, and a stationary cam cylinder incorporating therein the cam means.

DESCRIPTION OF THE PREFERRED EMBODIMENTS

An embodiment of the present invention will be described with reference to the drawings.

Figure 1:
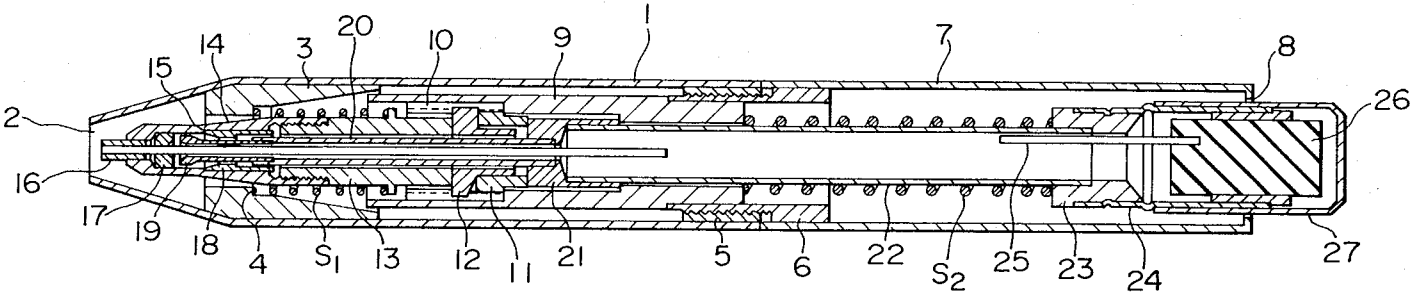
FIG. 1 is a cross-sectional view of a mechanical pencil according to an embodiment of the present invention.

FIG. 1 is a cross-sectional view of a mechanical pencil according to an embodiment of the invention. The mechanical pencil includes a front barrel 1 having a distal tapered end and having an opening 2. A spring seat 3 of a cylindrical configuration is fixedly fitted in the front barrel at its front portion, and has a shoulder 4 therein. The front barrel 1 has an adapter ring 5 fitted in its rear end portion, the ring 5 having an internally threaded portion. A separate cylindrical coupling 6 has a front externally threaded portion which is threaded into the internally threaded portion of the ring 5 fixedly mounted in the rear end portion of the front barrel 1. The coupling 6 has a rear half projecting rearward from the front barrel 1 and over which a rear barrel 7 is securely fitted. The rear barrel 7 has a rear end including an opening 8. The front barrel 1 and the rear barrel 7 jointly constitute a pencil barrel.

A cam cylinder 9 has a rear end fitted in a front half of the coupling 6. The cam cylinder 9 includes an inner cam wall 10 adjacent to its front end, the cam wall 10 being composed of axial shallow and deep grooves and a front engaging edge. A ring-shaped slide cam 11 is engaged with the cam wall 10. The slide cam 11 has on its outer circumferential surface ridges engaged with the shallow grooves in the cam wall 10 so that the slide cam 11 is prevented from rotating but is allowed to move back and forth. The slide cam 11 has a front inclined edge. A rotatable cam 12 is placed in front of the slide cam 11 and has on its outer circumferential surface ridges fitted in the deep grooves in the cam wall 10. The rotatable cam 12 has a rear inclined surface. The cam wall 10, the slide cam 11 and the rotatable cam 12 jointly constitute a back-and-forth movement mechanism which is widely used in push-actuated writing instruments.

A clamp support 13 is positioned in front of the rotatable cam 12 and has a projection on its outer circumferential surface. A spring $S_1$ is disposed between the projection on the clamp support 13 and the spring seat 3 for normally urging the clamp support 13 to move backwards. The clamp support 13 has an externally threaded front portion, and an internally threaded rear portion of an inner fitting 14 is threaded over the externally threaded portion of the clamp support 13. The inner fitting 14 is thus joined to the front end of the clamp support 13. The inner fitting 14 has an inner shoulder 15. A front pipe 16 is mounted in the distal end of the inner fitting 14, and a resilient lead holder 17 is mounted in the inner fitting 14 adjacent to its distal end. The lead holder 17 serves to hold a lead therein with a light force.

A clamp 18 is disposed in the inner fitting 14, and movable back and forth between the shoulder 15 in the inner fitting 14 and the front end of the clamp support 13. A chuck 19 is fitted in the clamp 18, and a lead pipe 20 is joined to a rear end of the chuck 19. The lead pipe 20 is quite thin and has an inside diameter small enough to allow passage therethrough of one lead at a time. The lead pipe 20 is located to pass through the clamp support 13, the rotatable cam 12, the slide cam 11 and others. The lead pipe 20 has a rear end to which a pusher 21 is connected. When the mechanical pencil is pushed, the rear end of the slide cam 11 is pushed by the front end of the pusher 21. The rear end of the pusher 21 will abut against a shoulder defined in the cam cylinder 9 so that the pusher 21 will be prevented from moving back beyond a certain interval.

A lead casing 22 has a front end portion pressed into a rear half portion of the pusher 21, so that the lead casing 22 is coupled to the rear end of the pusher 21. The lead casing 22 extends into the rear barrel 7 and has an attachment ring 23 fitted over the outer circumferential surface of a rear end portion thereof. A spring $S_2$ is disposed between the attachment ring 23 and the cam cylinder 9 for urging the chuck 19, the lead pipe 20, the pusher 21, the lead casing 22 and others to move backwards.

A cylindrical body 24 is fitted over the outer circumferential surface of the attachment ring 23. An eraser 26 with a cleaner pin 25 is fitted in the cylindrical body 24, and a push cap 27 is fitted over the cylindrical body 24. The push cap 27 projects backwards through the rear opening 8 in the rear barrel 7.

FIG. 1 shows the position in which the front pipe 16 and the inner fitting 14 are placed in the pencil barrel. In this position, the rotatable cam 12 is retracted in the cam wall 10, and the clamp support 13 is retracted under the force of the spring $S_1$. The chuck 19, the lead pipe 20, the pusher 21 and the lead casing 22 are also retracted under the force of the spring $S_2$. The rear end of the pusher 21 is prevented from moving back as it abuts against the shoulder in the cam cylinder 9. Therefore, the chuck 19 is placed out of the clamp 18 to release a lead. While the mechanical pencil is carried by the user, the parts are positioned as shown in FIG. 1. Therefore, there is no tendency for front pipe 16 to break the user's clothes or injure the user, or for the lead to smear the user's clothes. When the mechanical pencil is dropped, the front pipe 16 is not damaged. Since the lead is not clamped by the chuck, it will not be broken off upon impact.

Figure 2:
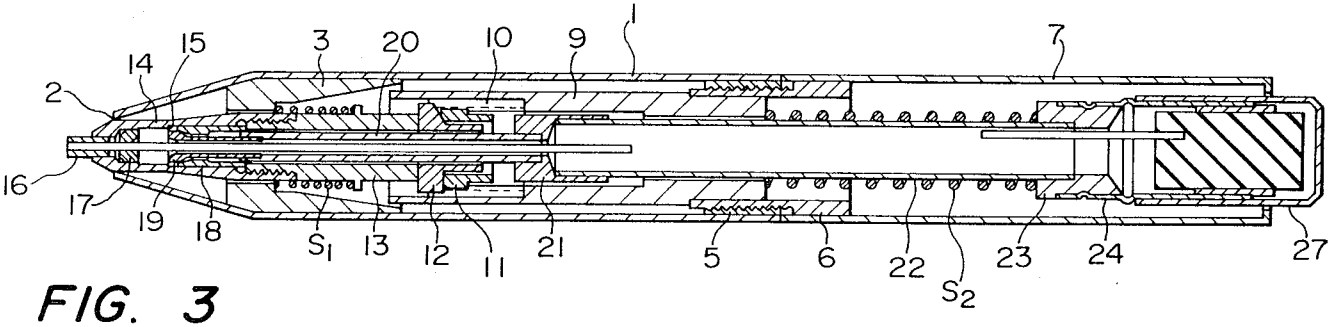
FIGS. 2 and 3 are cross-sectional views showing operations of the mechanical pencil of the invention.

To bring the mechanical pencil into a writing mode, the push cap 27 is pushed. By pushing the push cap 27, the pusher 21 is advanced through the cylindrical body 24, the attachment ring 23 and the lead casing 22 while compressing the spring $S_2$, and at the same time the lead pipe 20 and the chuck 19 are also advanced. The pusher 21 then advances the slide cam 11, which in turn moves forward to push the rotatable cam 12. The rotatable cam 12 advances the clamp support 13 while compressing the spring $S_1$, and the inner fitting 14 is also advanced. When the rotatable cam 12 moves slightly past the front end of the cam wall 10, the rotatable cam 12 is also slightly rotated along the front inclined edge of the slide cam 11. When the push on the push cap 27 is stopped at this time, the clamp support 13 is slightly retracted under the resiliency of the spring $S_1$ to move the rotatable cam 12 backwards. However, upon contact with the front engagement edge of the cam wall 10, the rotatable cam 12 is prevented from being retracted further, and the clamp support 13 and other parts are also kept from moving backwards further. The chuck 19, the lead pipe 20, the pusher 21, the lead casing 22 and so on are however caused to move backwards under the bias of the spring $S_2$. The chuck 19 and these elements are stopped in their retracting movement when the clamp 18 hits the front end of the clamp support 13 with chuck 19 fitting into the clamp 18 to grip the lead. At this time, the distal ends of the front pipe 16 and the inner fitting 14 project through the opening 2 in the front barrel 1. FIG. 2 shows the parts under this condition.

To project the lead through the front pipe 16 in this position, the push cap 27 is pushed with a small push. The manner in which the lead is projected with the push on the push cap is well known in conventional push-actuated mechanical pencils, and hence will not be described. This is described, for example, in U.S. Pat. No. 3,724,960. To bring the parts from the writing position of FIG. 2 back to the storage position of FIG. 1, the push cap 27 is pushed with a large push. The manner in which the components are brought back into the pencil barrel is also known in mechanical pencils having an internal back-and-forth movement mechanism, and will not be described. This is also described in U.S. Pat. No. 3,724,960.

While a certain embodiment of the invention has been shown and described, the present invention should not be interpreted as being limited to the illustrated embodiment. For example, although the spring seat 3 is shown as cylindrical in shape, it may be of any desired shape, construction and size provided it be capable of receiving the front end of the spring $S_1$. The spring seat 3 is a component which will be shaped, constructed and sized so as to fit in pencil barrels which each writing tool company has available in stock. With the distal end of the spring $S_1$ held in direct engagement with the inner face of the front barrel 1, the spring seat 3 may be dispensed with. This holds true for the means for attaching the cam cylinder 9 to the pencil barrel. Such attaching means is not limited to that illustrated, but may also be shaped, constructed and sized so as to fit in pencil barrels which each writing tool company has available in stock.

As described above, the mechanical pencil according to the present invention has the chuck 19 and the lead casing 22 interconnected by the lead pipe 20 of a diameter small enough to allow passage therethrough of only one lead at a time, and includes a back-and-forth movement mechanism disposed around the slender lead pipe 20 and composed of the cam wall 10, the slide cam 11 and the rotational cam 12. The pencil barrel of the invention can be of a much smaller diameter than that of conventional pencil barrels with a cam mechanism disposed therearound. The resultant mechanical pencil is slender in profile.

With the mechanical pencil of the invention, the slide cam 11 and the rotational cam 12 are housed in the cam cylinder 9 which has the cam wall 10 therein and which is separate from the pencil barrel, and the separate cam cylinder is fixedly mounted in the pencil barrel. Only the means for attaching the cam cylinder 9 to the pencil barrel is related to the barrel (where the spring seat 3 is used, it also is related to the barrel), and the other internal mechanism is independent of the pencil barrel. Consequently, it is possible for only one manufacturer to produce internal mechanisms and sell them to other writing tool companies, who can order shapes and dimensions of adjustable parts or adaptors for mounting cam cylinders 9, and if necessary also can order spring seats 3 of desired shapes and dimensions. The writing tool companies then can sell products under their own brands simply by assembling the purchased internal mechanisms into pencil barrels of their own make. The manufacturer of internal mechanisms can mass-produce versatile internal mechanisms at a reduced cost, and sell them to a plurality of writing tool companies inexpensively. The writing tool companies then can assemble the purchased internal mechanisms into their pencil barrels and sell completed products under their own brand names. Therefore, the internal mechanism maker, the writing tool companies, and the consumers can benefit from an efficient production and sale system.

Figure 4:
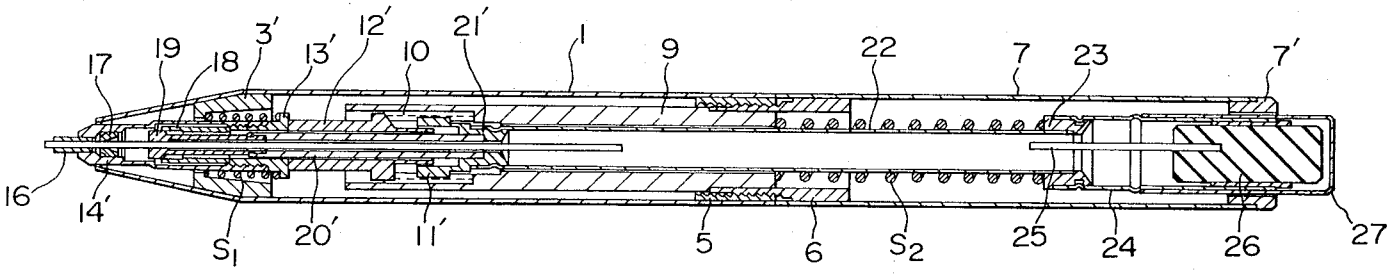
FIG. 4 is a cross-sectional view of a mechanical pencil according to another embodiment of the present invention.

FIG. 4 shows another embodiment of the invention in which like parts and components are designated by the same reference numerals as used in the previous embodiment. In FIG. 4, the modified parts and components are designated by the same reference numerals with primes. The embodiment shown in FIG. 4 is more available for practical design embodying the invention. The constructions and operations of respective components shown in FIG. 4 are substantially the same as those of the previous embodiment. Therefore, the same explanations have been omitted. The modified components will hereinafter be explained.

Figure 3:
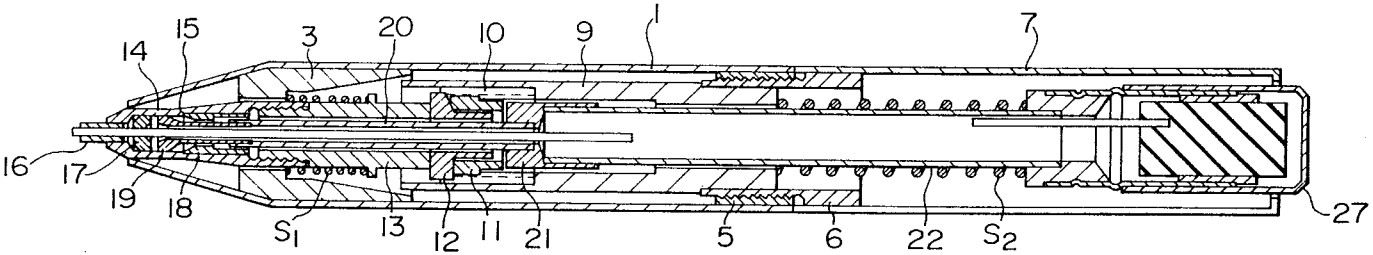

In the embodiment shown in FIG. 4, an inner fitting 14' has an rear end portion with a slightly greater inner diameter and a clamp support 13' which is much shorter than that shown in FIGS. 1 to 3. In order to cover the reduction, in length, of the clamp support 13', a rotatable cam 20' is elongated in axial length. Also, in FIG. 4, a slide cam 11' is made integral with a pusher 21' which is firmly coupled to the front end of the lead casing 22. The lead pipe 20' is firmly inserted at its rear end into an opening of the slide cam 11' and the pusher 21'. In addition, a rear end ring 7' is provided at the rear end of the pencil barrel. The overall length of a spring receiver is shortened as shown.

Figure 5:
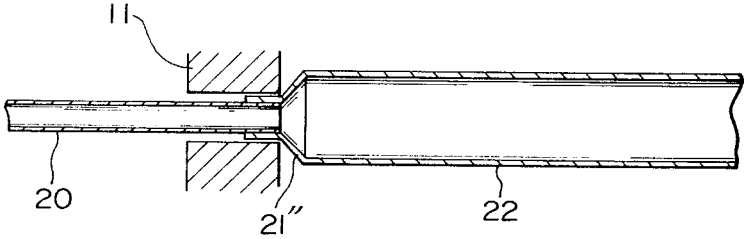
FIG. 5 is a fragmentary cross-sectional view showing a modification of the invention.

FIG. 5 shows a modification according to the present invention. In the foregoing embodiments, the pushers 21 and 21' are used. It is, however, possible to modify the lead casing 22 to have a function to push the slide cam 11 at its shouldered portion 21'', as shown in FIG. 5.

What is claimed is:

1. An internal mechanism for a pencil barrel of a mechanical pencil, said pencil barrel having a front opening and a rear opening at front and rear ends, respectively, said internal mechanism comprising:

a first movable mechanism including an inner fitting (14) having an opening through which a lead is supplied and a clamp support (13) coupled to said inner fitting, first biasing means for biasing said first movable mechanism rearwardly, lead holding means (17) mounted in said inner fitting (14) for holding the lead with a light force, a cylindrical clamp (18) located behind said lead holder (17) and movable back and forth by a short distance in said first movable mechanism, a second movable mechanism including a chuck (19) cooperating with said cylindrical clamp (18), a lead pipe (20) connected to a rear end of said chuck (19) and having a diameter small enough to allow passage therethrough of only one lead at a time, lead casing (22) connected to said lead pipe (20) for encasing therein extra leads, and a pusher (21), second biasing means for biasing said second movable mechanism rearwardly, cam means for retaining said first movable mechanism selectively between a retracted position and a writing position, said cam means actuated by said pusher (21) of said second movable mechanism, said cam means comprising a slide cam (11) and a rotatable cam (12) disposed in front of said slide cam (11), said lead pipe (20) extending through said slide cam (11), a cam cylinder (9) incorporating therein said cam means, and means for holding said cam cylinder stationary with respect to the pencil barrel during operation of said internal mechanism, whereby said internal mechanism is wholly self-contained.

2. The internal mechanism according to claim 1, wherein in said retracted position, the lead held by said lead holding means is retracted in said pencil barrel and in said writing position, the lead held by said lead holding means is extruded through said front opening of said pencil barrel.

3. The internal mechanism according to claim 1, said cam means including a cam wall (10) formed on an inner circumferential surface of said cam cylinder (9), said slide cam (11) being cylindrical in shape and engaged with said cam wall slidably in the axial direction of said pencil barrel.

4. The internal mechanism according to claim 3, wherein said rotatable cam (12) is located around said lead pipe (20).

5. The internal mechanism according to claim 1, said first biasing means including a first spring ($S_1$) interposed between at a part of said clamp support (13) and a stationary part of said pencil barrel.

6. The internal mechanism according to claim 1, said second biasing means including a second spring ($S_2$) interposed between a part of said lead casing (22) and a rear end of said cam cylinder (9).

7. The internal mechanism according to claim 1, further including means for stopping said second movable mechanism against the force of said second biasing means.

8. An internal mechanism as claimed in claim 1, said means for holding said cam cylinder (9) stationary comprising a cylindrical coupling (6) fitting around said cam cylinder (9) and insertable into a rear portion of the pencil barrel, and an adapter ring (5) attachable to said cylindrical coupling (6) at a front portion thereof, and insertable into a front portion of the pencil barrel.

9. A mechanical pencil comprising an outer pencil barrel and a pencil mechanism insertable into said pencil barrel, said pencil mechanism comprising a cam cylinder (9) having a cam wall (10) formed on an inner circumferential surface, means for holding said cam cylinder stationary with respect to said pencil barrel during operation of said pencil mechanism, a cylindrical slide cam (11) engaged with the cam wall (10) for back-and-forth movement therein, a rotatable cam (12) disposed in front of the slide cam (11) and having a central hole, an inner fitting (14) and a clamp support (13) connected together and disposed in front of the rotatable cam, means for pushing said slide cam (11), a spring ($S_1$) for urging the inner fitting (14) and the clamp support (13) to move backwardly, a lead holder (17) mounted in the inner fitting (14) for holding a lead with a light force, a cylindrical clamp (18) disposed behind the lead holder (17) and movable back and forth by a slight interval, a chuck (19) fitted in the clamp (18), a lead pipe (20) connected to a rear end of the chuck (19) and having a diameter small enough to allow passage therethrough of only one lead at a time, the lead pipe (20) extending through the rotatable cam (12) and the slide cam, a lead casing (22) connected to a rear end of the lead pipe (20), another spring ($S_2$) for urging the interconnected chuck (19), lead pipe (20) and lead casing (22) to move backwardly, and means for preventing the chuck (19), the lead pipe (20) and the lead casing (22) from being retracted beyond a certain interval, whereby said pencil mechanism is wholly self-contained.

10. The mechanical pencil according to claim 9, wherein said pushing means is provided integrally with said slide cam.

11. The mechanical pencil according to claim 9, wherein said pushing means is provided integrally with said lead pipe.

12. The mechanical pencil according to claim 9, wherein said pushing means is interposed between said slide cam and said lead pipe.

13. A mechanical pencil as claimed in claim 9, said means for holding said cam cylinder (9) stationary comprising a cylindrical coupling (6) fitting around said cam cylinder (9) and insertable into a rear position of said pencil barrel, and an adapter ring (5) attachable to said cylindrical coupling (6) at a front portion thereof, and insertable into a front portion of said pencil barrel.

* * * * *